United States Patent [19]

Clarke et al.

[11] 3,972,657

[45] Aug. 3, 1976

[54] SLANT AXIS ROTARY MECHANISM

[75] Inventors: John M. Clarke, Mollington, near Banbury, England; Paul J. Staebler, Dunlap, Ill.

[73] Assignee: Caterpillar Tractor Co., Peoria, Ill.

[22] Filed: Nov. 12, 1975

[21] Appl. No.: 631,017

[52] U.S. Cl. ..... 418/53

[51] Int. Cl.[2] ..... F01C 1/02

[58] Field of Search ..... 418/49, 50, 51, 52, 418/53, 61 A

[56] References Cited

UNITED STATES PATENTS

| | | | |
|---|---|---|---|
| 410,308 | 9/1889 | Bowns | 418/53 |
| 2,997,000 | 8/1961 | Becker et al. | 418/153 |
| 3,485,218 | 12/1969 | Clarke | 418/53 |

FOREIGN PATENTS OR APPLICATIONS

| | | | |
|---|---|---|---|
| 561,447 | 10/1932 | Germany | 418/53 |

*Primary Examiner*—C. J. Husar
*Assistant Examiner*—Leonard Smith
*Attorney, Agent, or Firm*—Wegner, Stellman, McCord, Wiles & Wood

[57] ABSTRACT

An improved slant axis rotary mechanism such as an engine, a compressor, pump, or the like. The mechanism includes a housing defining an operating chamber and a shaft is journalled within the housing. The shaft includes an angularly offset portion within the chamber, the angularly offset portion including an outwardly opening peripheral groove. A thrust collar is disposed in the groove and a rotor is journalled on the angularly offset portion. The rotor is formed of two rotor segments secured together with the rotor segments, at their interface, including complementary groove parts clampingly receiving the thrust collar.

3 Claims, 3 Drawing Figures

Fig. 1
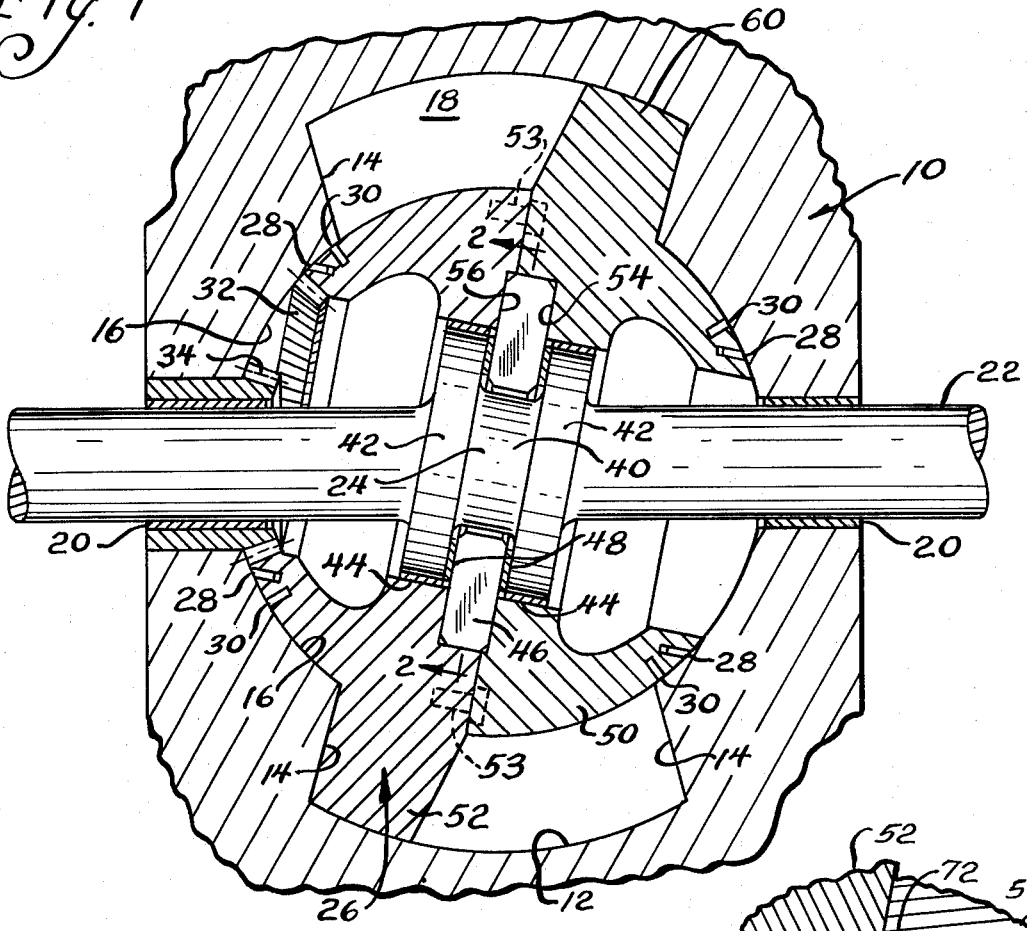
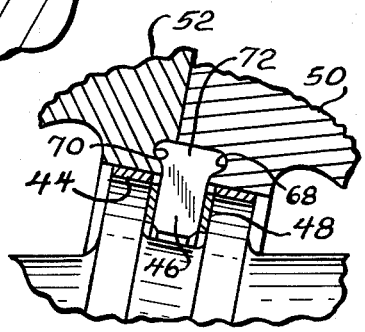
Fig. 3
Fig. 2
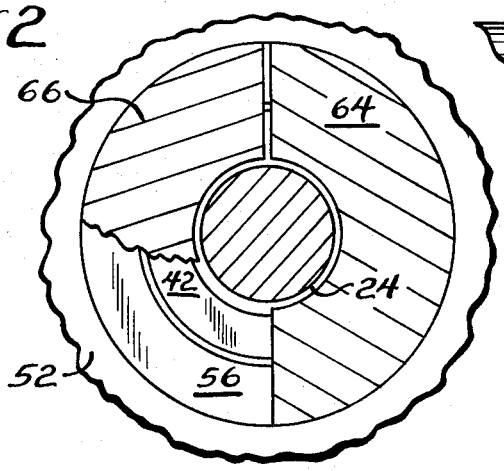

SLANT AXIS ROTARY MECHANISM

BACKGROUND OF THE INVENTION

This invention relates to rotary mechanisms, and, more specifically, to slant axis rotary mechanisms for use as engines, compressors, pumps, or the like.

Slant axis rotary mechanisms include an angularly offset portion in their shaft disposed within an operating chamber. A rotor is conventionally journalled on the angularly offset portion as is well known.

In order to assemble the rotor on the shaft, it is necessary to either split the shaft or the rotor. When the shaft is split, the same is seriously weakened thereby diminishing the capacity of the mechanism.

Heretofore, when the second approach is taken, namely, the splitting of the rotor, the rotor has been left largely in one piece with the split being made at a relatively small diameter. In effect, the rotor is held assembled to the shaft by a large diameter nut. This approach is not altogether satisfactory in that large loads are imposed on the point of connection, normally threads, which loads are cyclic in nature and therefore conducive to fatigue failure.

SUMMARY OF THE INVENTION

It is the principal object of the invention to provide a new and improved slant axis rotary mechanism. More specifically, it is an object of the invention to provide such a mechanism wherein the rotor is constructed in two segments, each comprising on the order of half of the rotor to avoid weakened shafts or connections subject to large loads.

The exemplary embodiment of the invention achieves the foregoing object in a slant axis rotary mechanism including a housing defining an operating chamber. A shaft is journalled within the housing and the shaft includes an angularly offset portion within the chamber. The angularly offset portion includes an outwardly opening peripheral groove and a thrust collar is disposed in the groove. A rotor is journalled on the angularly offset portion and is formed of two rotor segments secured together. The rotor segments, at their interface, include complementary groove parts clamping and receiving the thrust collar.

In a highly preferred embodiment, the thrust collar is formed of at least two segments for ease of assembly. In addition, the collar may include a radially outer, peripheral, bulbous enlargement clampingly received between the rotor segments.

In the best form of the invention contemplated, the rotor segments each are on the order of half of a complete rotor.

Other objects and advantages will become apparent from the following specification taken in connection with the accompanying drawings.

DESCRIPTION OF THE DRAWINGS

FIG. 1 is a sectional view of a slant axis rotary mechanism made according to the invention;

FIG. 2 is a sectional view taken approximately along the line 2—2 of FIG. 1; and FIG. 3 is a fragmentary sectional view of a modified embodiment of the invention.

DESCRIPTION OF THE PREFERRED EMBODIMENTS

An exemplary embodiment of a slant axis rotary mechanism made according to the invention is illustrated in the form of an engine in FIG. 1. It is to be understood, however, that the invention is susceptible to use in slant axis rotary mechanisms other than engines, such as compressors, pumps, or the like.

The slant axis rotary mechanism includes a housing, generally designated 10, having a first outer partial spherical surface 12, generally radial surfaces 14 and radially inner spherical surfaces 16 which define an operating chamber 18. By means of bearings 20, the housing 10 journals a shaft 22 having an angularly offset portion 24 within the operating chamber 18. The angle of the offset of the angularly offset portion 24 is chosen to equal the so-called "wobble angle" as is well known.

A rotor, generally designated 26, is journalled on the angularly offset portion 24 and includes oil seals 28 and compression seals 30 sealingly engaging the radially inner spherical wall 16 at opposite ends of the rotor 26. In addition, the rotor 26 includes an internal gear 32 at one end thereof in mesh with a stationary gear 34 whereby timing of rotation of the rotor 26 relative to the shaft 22 is obtained.

The angularly offset portion 24 of the shaft 22 includes an outwardly opening peripheral groove 40 flanked by two lands 42 which journal, by means of bearings 44, the rotor 26 on the shaft 22. Disposed within the groove 40 is a thrust collar 46. Suitable bearings 48 may be interposed between the thrust collar 46 and the sides of the groove 40.

The rotor 26 is preferably made up of two rotor segments 50 and 52 which are secured together by any suitable means such as cap screws 53, shown somewhat schematically in FIG. 1. Alternately, suitable bolts, rivets, or the like, could be employed for the purpose.

At the interface between the rotor segments 50 and 52, there are provided complementary groove parts 54 and 56 for receipt of a radially outwardly extending portion of the thrust collar 46. The arrangement is such that when the rotor segments 50 and 52 are assembled, the thrust collar 46 is clampingly received within the complementary groove parts 54 and 56.

In general, the interface of the rotor segments 50 and 52 will describe a wavy surface. The precise form will depend upon the shape of the conventional rotor flange 60. The joint line may be entirely within the flange and may be provided with serrations or the like to enhance the rigidity of the assembled rotor. The complementary groove parts 54 and 56 will accordingly vary in depth about each rotor half so as to define a generally cylindrical groove.

For ease of assembly, and as shown in FIG. 2, it is preferable that the thrust collar 46 be formed of at least two segments 64 and 66. Of course, if desired, more could be employed.

A highly preferred embodiment of the invention is illustrated in FIG. 3. In the case of FIG. 3, the complementary groove parts 54 and 56 in the rotor segments 50 and 52 each include an axial recess 68 and 70, respectively. The thrust collar 46 is formed with a radially outer, peripheral, bulbous enlargement 72 for receipt in the recesses 68 and 70. This arrangement facilitates retention of the split thrust collar 46 in the assembly.

From the foregoing, it will be appreciated that a slant axis rotary mechanism made according to the invention enables easy assembly of the rotor upon the shaft without the need for splitting of the shaft or the use of connections, as, for example, threaded connections, which are subject to large cyclic loads. Consequently, ease of assembly is retained while capacity of the mechanism is increased.

What is claimed is:

1. In a slant axis rotary mechanism, the combination of, a housing defining an operating chamber;

a shaft journalled within said housing, said shaft including an angularly offset portion within said chamber;

said angularly offset portion including an outwardly opening peripheral groove;

a thrust collar disposed in said groove; and a rotor journalled on said angularly offset portion, said rotor being formed of two rotor segments secured together, said rotor segments, at their interface, including complementary groove parts clampingly receiving said thrust collar.

2. The slant axis rotary mechanism of claim 1 wherein said thrust collar is formed of at least two segments.

3. The slant axis rotary mechanism of claim 1 wherein said collar includes a radially outer, peripheral bulbous enlargement clampingly received between said rotor segments.

* * * * *